US010100831B2

(12) United States Patent
Wu et al.

(10) Patent No.: US 10,100,831 B2
(45) Date of Patent: Oct. 16, 2018

(54) LIQUID PUMP

(71) Applicant: Johnson Electric S.A., Murten (CH)

(72) Inventors: Chunfa Wu, Shenzhen (CN); Jie Zuo, Shenzhen (CN)

(73) Assignee: JOHNSON ELECTRIC S.A., Murten (CH)

( * ) Notice: Subject to any disclaimer, the term of this patent is extended or adjusted under 35 U.S.C. 154(b) by 626 days.

(21) Appl. No.: 14/226,667

(22) Filed: Mar. 26, 2014

(65) Prior Publication Data

US 2014/0294627 A1 Oct. 2, 2014

(30) Foreign Application Priority Data

Mar. 26, 2013 (CN) ..... 2013 1 0100901

(51) Int. Cl.

| | |
|---|---|
| ***F04C 2/18*** | (2006.01) |
| ***F04C 15/00*** | (2006.01) |
| ***F04C 15/06*** | (2006.01) |
| ***F04C 2/08*** | (2006.01) |
| ***F04C 2/10*** | (2006.01) |

(52) U.S. Cl.

CPC ..... *F04C 2/18* (2013.01); *F04C 2/084* (2013.01); *F04C 2/102* (2013.01); *F04C 15/0003* (2013.01); *F04C 15/0015* (2013.01); *F04C 15/0026* (2013.01); *F04C 15/06* (2013.01); *F05C 2225/00* (2013.01)

(58) Field of Classification Search

CPC ..... F04C 2/18; F04C 15/06; F04C 15/0003; F04C 2/086; F04C 15/0026; F04C 2/102; F04C 2/084; F04C 29/02; F02M 37/04; F16J 15/3208

USPC ..... 418/75–77, 131, 132, 206.1–206.8

See application file for complete search history.

(56) References Cited

U.S. PATENT DOCUMENTS

| | | | | | |
|---|---|---|---|---|---|
| 4,358,260 | A * | 11/1982 | Joyner | F01C 19/085 | 418/132 |
| 4,674,960 | A * | 6/1987 | Rando | F04C 23/00 | 29/888.023 |
| 5,022,837 | A * | 6/1991 | King | F04C 15/0026 | 418/132 |
| 5,297,945 | A * | 3/1994 | Loubier | A23G 3/021 | 418/206.5 |

(Continued)

FOREIGN PATENT DOCUMENTS

| | | | | |
|---|---|---|---|---|
| GB | 1346474 A * | 2/1974 | ..... | F04C 2/101 |
| WO | WO 2012152924 A2 * | 11/2012 | ..... | F04C 2/126 |

*Primary Examiner* — Devon Kramer
*Assistant Examiner* — Thomas Cash
(74) *Attorney, Agent, or Firm* — Muncy, Geissler, Olds & Lowe, P.C.

(57) ABSTRACT

A liquid pump includes a pump assembly attached to a motor. The pump assembly includes an inlet chamber and pump chamber. The pump chamber accommodates a drive gear driven by an output shaft of the motor and driven gear meshed with the drive gear. An inner cover is disposed within the pump chamber. An outer cover overlies the inner cover with an elastic member disposed there between. The outer cover exerts a force to the inner cover through the elastic member and holds the inner cover in sliding contact with an axial end of the drive and driven gears. An outlet chamber formed between the inner cover and the outer cover is in fluid communication with and the pump chamber.

10 Claims, 12 Drawing Sheets

(56) References Cited

U.S. PATENT DOCUMENTS

| | | | | |
|---|---|---|---|---|
| 5,725,362 | A * | 3/1998 | Zepp | F04C 2/086 417/366 |
| 6,612,821 | B1 * | 9/2003 | Kuijpers | F04C 2/14 418/152 |
| 6,652,250 | B2 * | 11/2003 | Yoshimura | F01C 21/02 417/410.4 |
| 2002/0044876 | A1 * | 4/2002 | Yoshimura | F01C 21/02 417/410.4 |
| 2005/0238505 | A1 * | 10/2005 | Iwasaki | F04C 2/086 417/410.4 |
| 2007/0134120 | A1 * | 6/2007 | Fujita | F01C 21/108 418/112 |
| 2011/0223049 | A1 * | 9/2011 | Rudolph | F02M 37/04 418/102 |

* cited by examiner

LIQUID PUMP

CROSS REFERENCE TO RELATED APPLICATION(S)

This application claims the benefit of Chinese Patent Application Serial No. 201310100901.3, filed on Mar. 26, 2013. The entire contents of the aforementioned patent application are hereby incorporated by reference for all purposes.

BACKGROUND

Liquid pumps are used in many applications, such as, for example, beverage dispensers commonly found in restaurants or cafes. After a user presses an appropriate button, inserts a correct amount of money, or otherwise interacts with the beverage dispenser, a pump mechanism within the beverage dispenser will dispense the beverage. As the functioning of the beverage dispenser is highly dependent upon the functioning state of the pump mechanism, it is desirable for the pump mechanism to be safe and reliable, and have a long operational life and efficient performance.

FIGS. 1A and 1B illustrate a liquid pump 100 used in the current art. Liquid pump 100 comprises a housing defining a pump chamber 102. An inlet 104 and an outlet 106 are located on opposite sides of the pump chamber 102. An output shaft 114 of a motor 112 extends through a through hole on a bottom wall 116 of pump chamber 102 to drive a drive gear 108 housed within pump chamber 102, wherein drive gear 108 is coupled to a driven gear 110 also contained within pump chamber 102. During pump operation, the rotation of drive gear 108 and driving gear 110 pumps fluid from inlet 104 to outlet 106 in a controlled manner.

A sealing member 118 disposed around output shaft 114 is located in a support base formed beneath bottom wall 116 of pump chamber 102, preventing leakage of liquid through gaps between output shaft 114 and the through hole on bottom wall 116.

An open end of pump chamber 102 is closed by an inner cover 120, which may be supported by shoulder portions 122 formed by the sidewalls of pump chamber 102. A sealing ring 124 is disposed between inner cover 120 and an outer cover 126. Pressure from outer cover 126 causes sealing ring 124 to exert a pressure on inner cover 120, causing inner cover 120 to maintain sliding contact with an axial surface of drive gear 108 and driven gear 110. In addition, sealing ring 124 and inner cover 120 form an interface with the side walls of pump chamber 102, preventing liquid in pump chamber 102 from leaking through inner cover 120.

During operation of pump 100, inner cover 120 rubs against the surface of drive gear 108 and driven gear 110, causing wear and tear. Continuous wear and tear may create a gap between inner cover 120 and the axial surfaces of drive and driven gears 108 and 110. In addition, the rotation of drive gear 108 and driven gear 110 causes the liquid within the pump chamber to be under high pressure, which exerts a force on inner cover 120 that may overcome the pressure exerted by sealing ring 124 and further increases the size of the gap, lowering the efficiency of pump 100.

Furthermore, during operation of pump 100, sealing member 118 is exposed directly to the high pressure from the liquid within pump chamber 102, causing greater wear and shorter operational life of sealing member 118, which decreases the operational life of pump 100 as a whole.

Accordingly, there exists a need for a liquid pump having a longer operational life and higher efficiency, addressing the problems described above.

SUMMARY

Some embodiments are directed at a liquid pump driven by a motor. In some embodiments, the motor drives one or more pump mechanisms within a pump chamber defined by a pump assembly shell, wherein the one or more pump mechanisms may comprise a drive gear and a driven gear. The pump assembly shell also defines an inlet chamber upstream of the pump chamber. The inlet chamber is disposed closer to the motor than the pump chamber, such that a shaft seal preventing fluid from leaking from the pump assembly at the motor output shaft is adjacent to the inlet chamber.

In some embodiments, an inner cover is disposed within the pump chamber between an outer cover and an axial surface of the pump mechanisms. An elastic member is disposed between the inner cover and outer cover, and configured to exert a pressure on the inner cover such that a surface of the inner cover maintains sliding contact with the axial surface of the pump mechanisms. The inner cover, outer cover, and elastic member define an outlet chamber located downstream from the pump chamber, such that the fluid pressure on either side of the inner cover is balanced.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered which are illustrated in the accompanying drawings. These drawings depict only exemplary embodiments and are not therefore to be considered limiting of the scope of the claims.

DETAILED DESCRIPTION

Figure 1A:
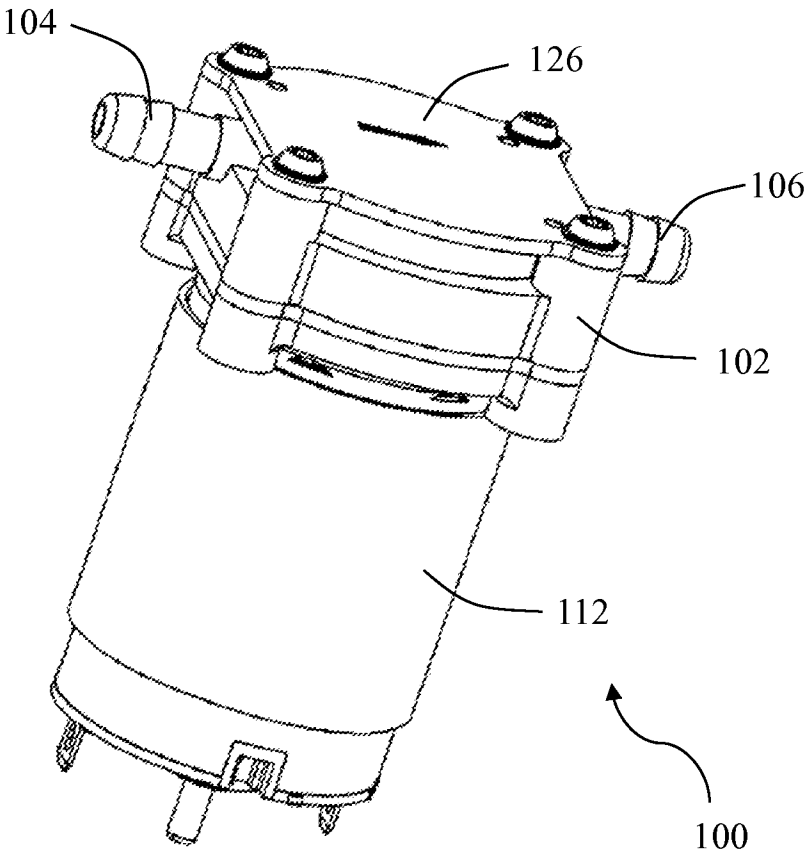
FIG. 1A (Prior Art)
FIGS. 1A and 1B illustrate a liquid pump as found in the prior art.
Figure 1B:
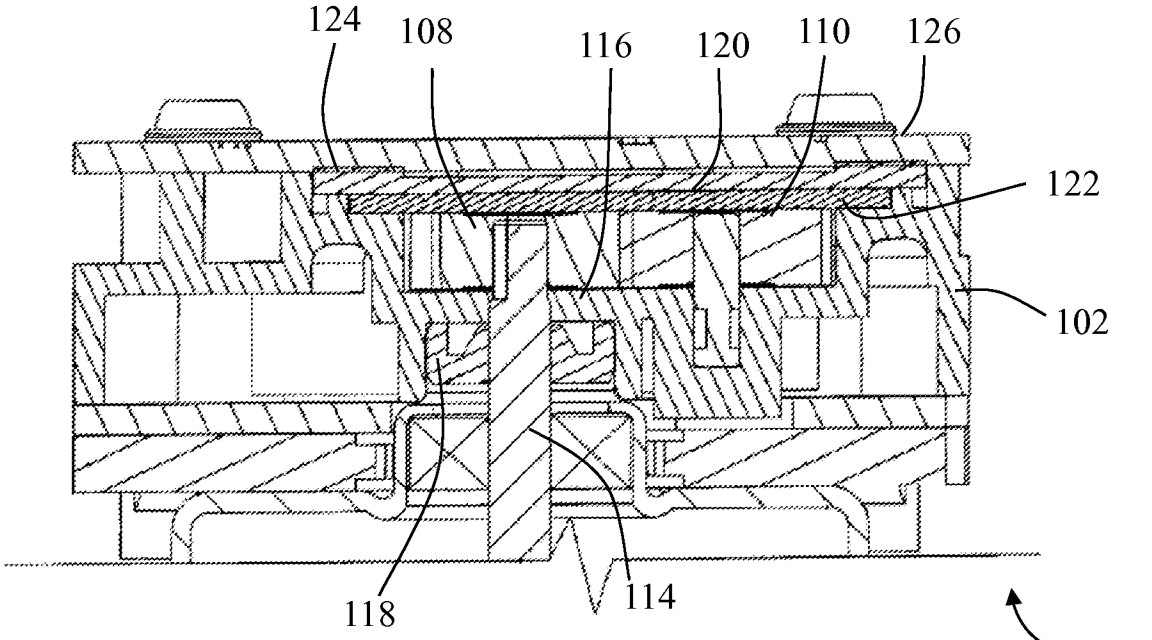
FIG. 1B (Prior Art)

Various features are described hereinafter with reference to the figures. It shall be noted that the figures are not drawn to scale, and that the elements of similar structures or functions are represented by like reference numerals throughout the figures. It shall also be noted that the figures are only intended to facilitate the description of the features for illustration and explanation purposes, unless otherwise specifically recited in one or more specific embodiments or claimed in one or more specific claims. The drawings figures and various embodiments described herein are not intended as an exhaustive illustration or description of various other embodiments or as a limitation on the scope of the claims or the scope of some other embodiments that are apparent to one of ordinary skills in the art in view of the embodiments described in the Application. In addition, an illustrated embodiment need not have all the aspects or advantages shown.

An aspect or an advantage described in conjunction with a particular embodiment is not necessarily limited to that embodiment and may be practiced in any other embodiments, even if not so illustrated, or if not explicitly described. Also, reference throughout this specification to "some embodiments" or "other embodiments" means that a particular feature, structure, material, process, or characteristic described in connection with the embodiments is included in at least one embodiment. Thus, the appearances of the phrase "in some embodiments", "in one or more embodiments", or "in other embodiments" in various places throughout this specification are not necessarily referring to the same embodiment or embodiments.

Some embodiments are directed at a liquid pump driven by a motor. In some embodiments, the motor drives one or more pump mechanisms within a pump chamber defined by a pump assembly shell, wherein the one or more pump mechanisms may comprise a drive gear and a driven gear. The pump assembly shell also defines an inlet chamber upstream of the pump chamber. The inlet chamber is disposed closer to the motor than the pump chamber, such that a shaft seal preventing fluid from leaking from the pump assembly at the motor output shaft is adjacent to the inlet chamber.

In some embodiments, an inner cover is disposed within the pump chamber between an outer cover and an axial surface of the pump mechanisms. An elastic member is disposed between the inner cover and outer cover, and configured to exert a pressure on the inner cover such that a surface of the inner cover maintains sliding contact with the axial surface of the pump mechanisms. The inner cover, outer cover, and elastic member define an outlet chamber located downstream from the pump chamber, such that the fluid pressure on either side of the inner cover is balanced.

Figure 2A:
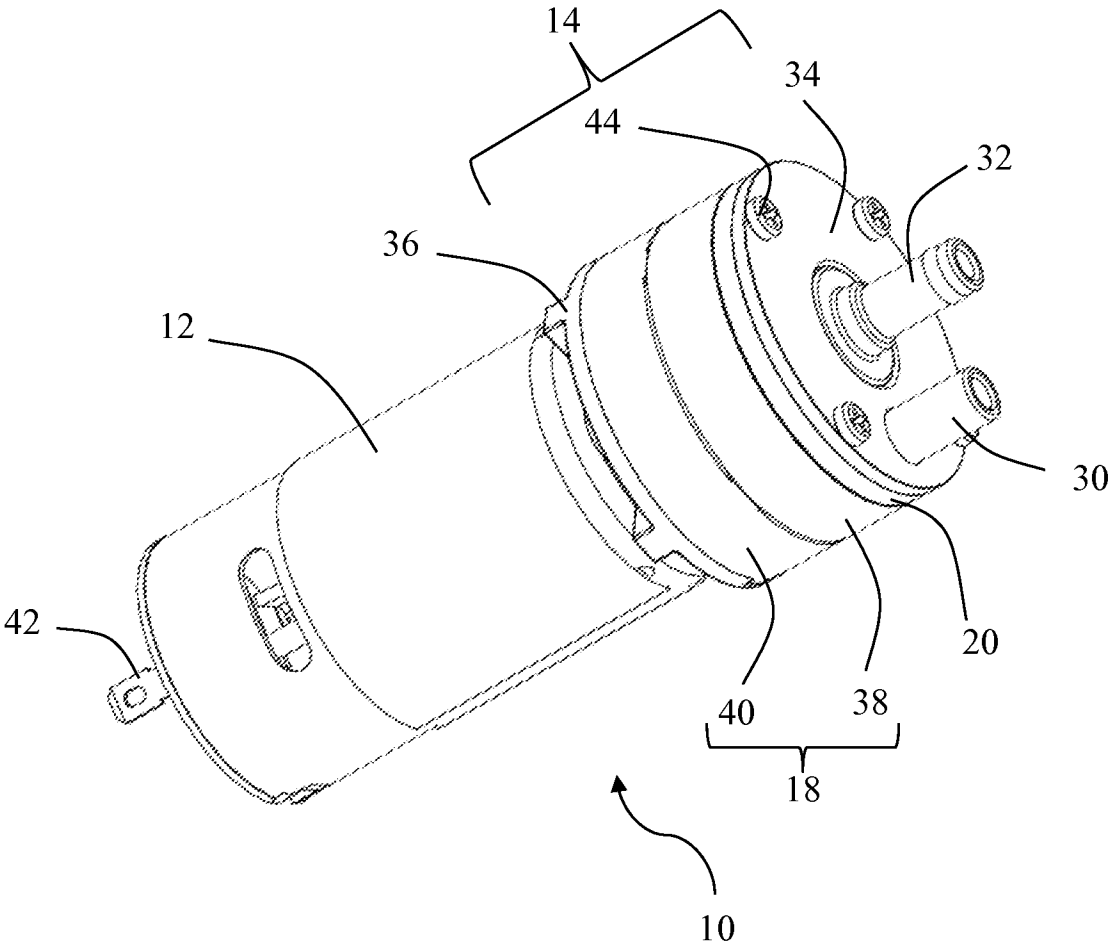
FIGS. 2A, 2B, and 2C illustrate a liquid pump in accordance with some embodiments.
Figure 2B:
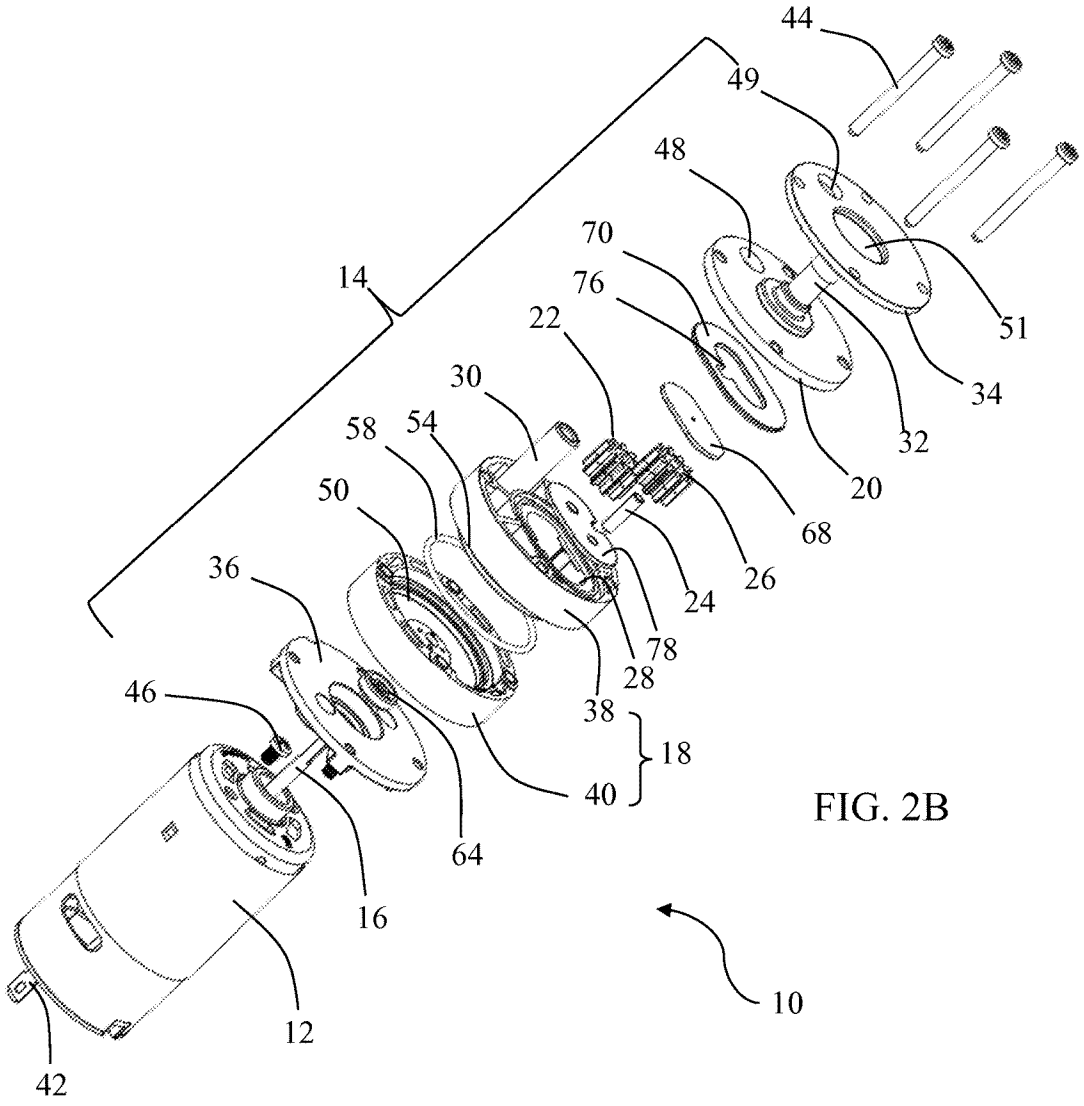
Figure 2C:
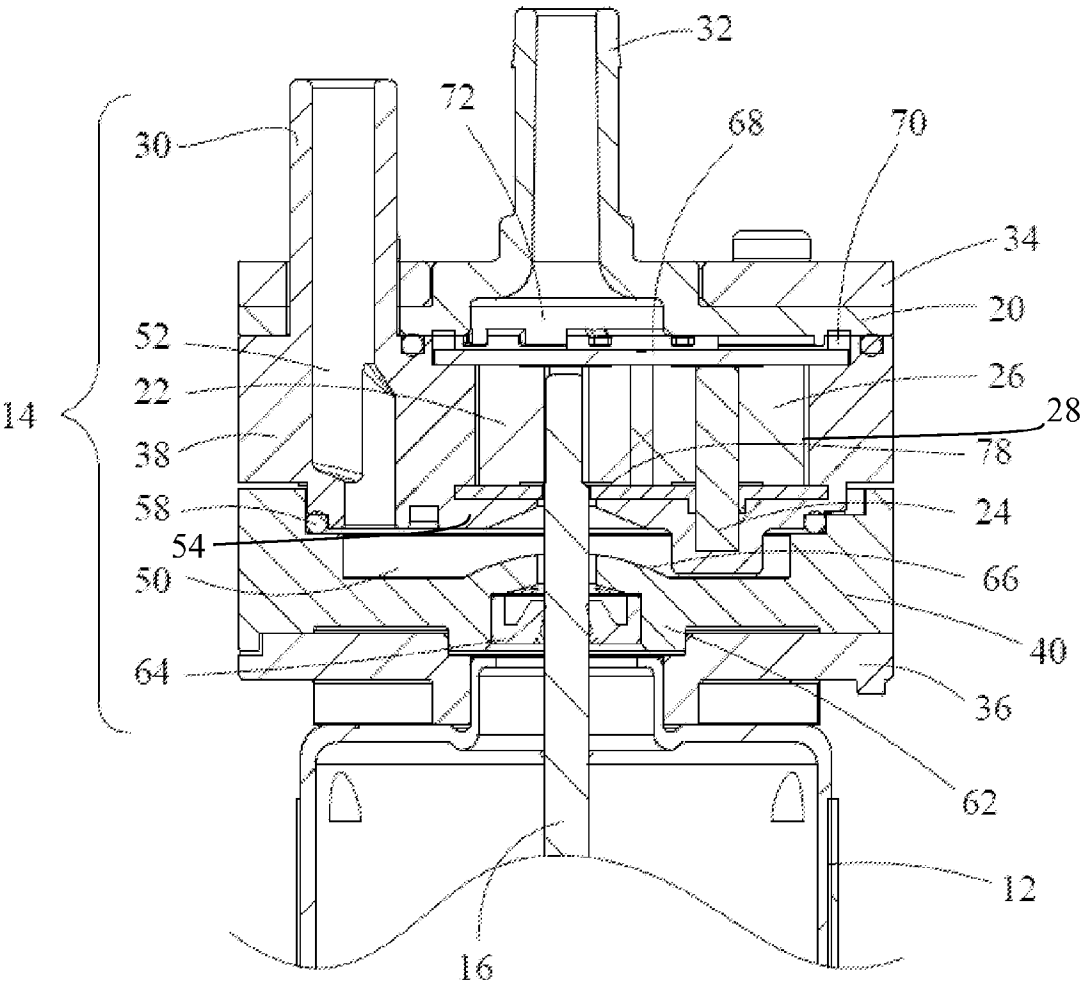

FIG. 2A illustrates a liquid pump 10 (hereinafter, "pump 10") in accordance with some embodiments. FIG. 2B illustrates an exploded view of pump 10; FIG. 2C illustrates a partial cross-section view of pump 10. In some embodiments, pump 10 is used in a beverage dispenser (e.g., a soda dispenser), although it is understood that a liquid pump in accordance with the present invention may be used for a variety of different applications involving the pumping of liquid.

In some embodiments, pump 10 comprises a pump assembly 14 driven by a motor 12. For ease of explanation, motor 12 will be referred to as being located below pump assembly 14, with an output shaft 16 of motor 12 being in a vertical orientation, although it is understood that in practice motor 12 and pump assembly 14 may be positioned in any orientation.

Motor 12 comprises electrical terminals 42 for receiving electrical power. Output shaft 16 may be attached to an axial ends of motor 12 using one or more bearings, sleeves, or any other components that provide mechanical coupling between moving and stationary parts (not shown). In some embodiments, motor 12 is a direct current (DC) motor.

Pump assembly 14 comprises a shell 18, an outer cover 20, and pump mechanisms. In some embodiment, the pump mechanisms may comprise a drive gear 22 configured to rotate synchronously with output shaft 16, and a driven gear 26 supported by a driven gear shaft 24 configured to spin with drive gear 22. Shell 18 comprises a pump chamber 28 in fluid communication with an inlet 30 and an outlet 32. Drive gear 22 and driven gear 26 are configured to spin within pump chamber 28. Although the illustrated embodiments show pump 10 using a pair of gears (drive gear 22 and driven gear 26) for pumping liquid, it is understood that in other embodiments, different methods for pumping liquid may be used (e.g., an impeller, a number of gears other than two, etc.).

Pump assembly 14 may be mounted to motor 12 using a mounting plate 36. In some embodiments, shell 18 is located between mounting plate 36 and outer cover 20, and comprises a first shell portion 38 adjacent to outer cover 20, and a second shell portion 40 adjacent to mounting plate 36. In some embodiments, an additional reinforcing plate 34 is located on a side of outer cover 20 remote from motor 12.

Reinforcing plate 34, outer cover 20, first shell portion 38, second shell portion 40, and mounting plate 36 may have substantially similar cross-sectional shapes and dimensions in a plane perpendicular to the axial direction of motor 12, and be attached to each other using one or more fastening means 44, such as, for example, bolts, or screws, through one or more corresponding through holes or bores. In addition, mounting plate 36 may be mounted to motor 12 through one or more fastening means 46, such as, for example, bolts, or screws, in order to secure pump assembly 14 to motor 12.

First shell portion 38 defines pump chamber 28, while second shell portion 40 defines an inlet chamber 50. Pump chamber 28 and inlet chamber 50 may be separated by a bottom wall 54 of first shell portion 38. In some embodiments, first shell portion 38 and second shell portion 40 are independently formed and assembled together with outer cover 20; while in other embodiments, first and second shell portions 38 and 40 may be integral and formed together. In some embodiments, a sealing ring 58 is disposed between first and second shell portions 38 and 40, to prevent liquid from leaking out between them.

Figure 3A:
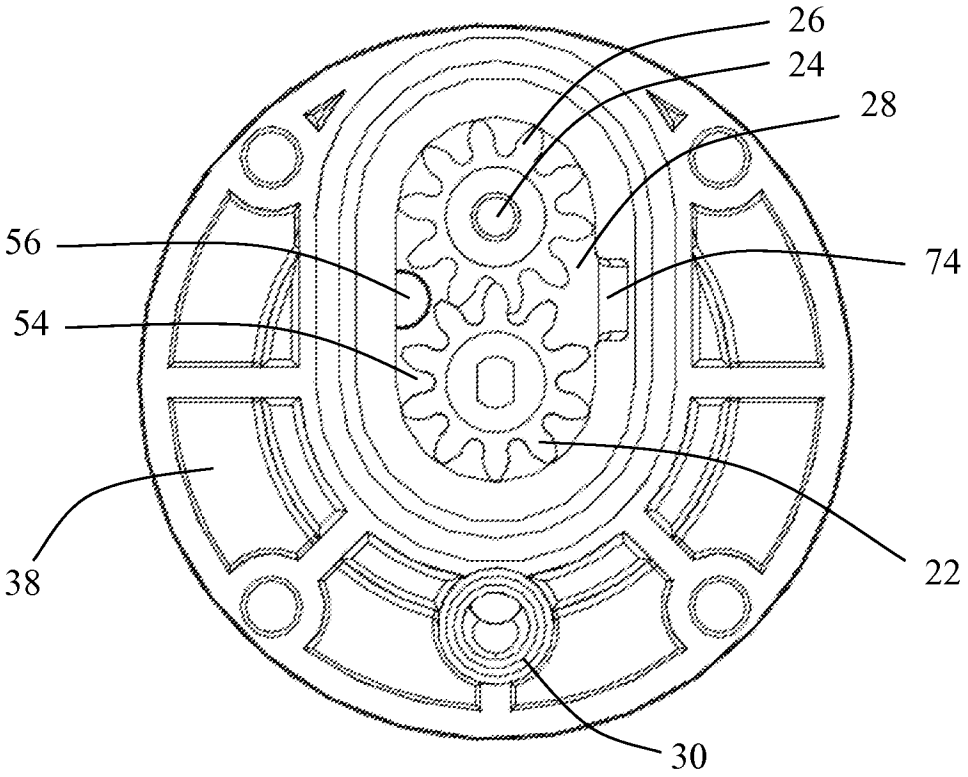
FIGS. 3A and 3B illustrate a first shell portion used in a liquid pump in accordance with some embodiments.
Figure 3B:
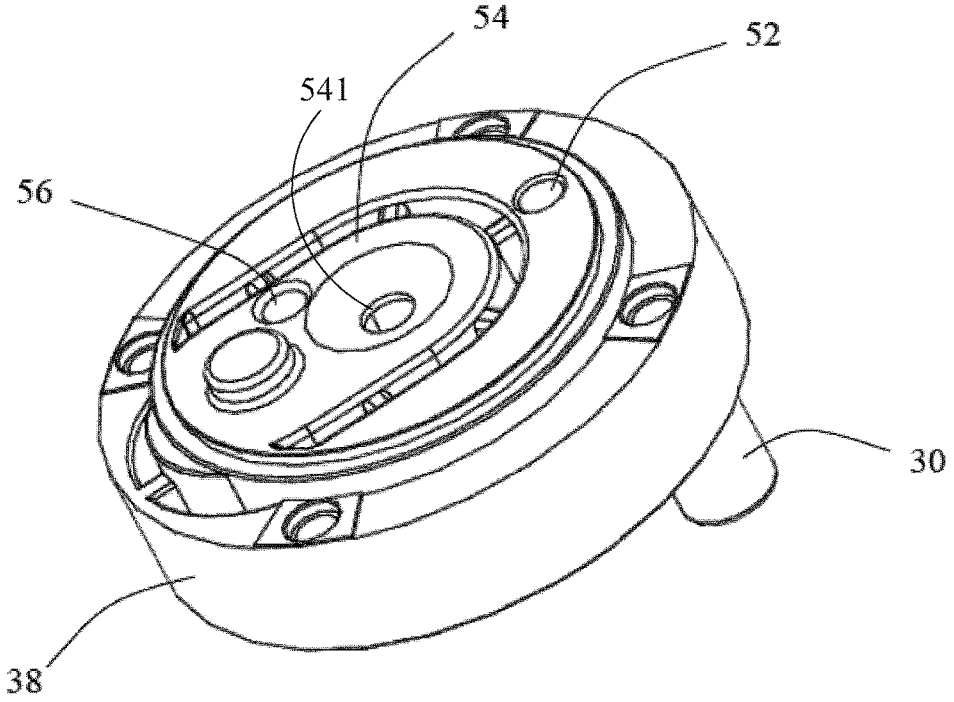

FIGS. 3A and 3B illustrate first shell portion 38 of pump 10. FIG. 3A also illustrates drive gear 22 and driven gear 26 within pump chamber 28 defined by first shell portion 38. FIG. 3B illustrates first shell portion 38 viewed from the bottom. In some embodiments, pump chamber 28 is substantially oval, ellipsoidal, or pill-shaped, as illustrated in FIG. 3A.

Drive gear 22 and driven gear 26 are rotatably accommodated within pump chamber 28. Drive gear 22 is fixed to output shaft 16 of motor 12, such that it spins synchronously with output shaft 16, which may be configured to pass through mounting plate 36, second shell portion 40, and bottom wall 54 of first shell portion 38, so that it extends into pump chamber 28 to interface with drive gear 22. Driven gear 26 is rotatably fixed to a driven shaft 24 on first shell portion 38, and configured to mesh with drive gear 22, such that they spin together.

Referring also to FIGS. 2B and 2C, inlet 30 extends from first shell portion 38 on one side of pump chamber 28, and comprises an opening 52 that passes through first shell portion 38 to extend to inlet chamber 50. Outlet 32 extends from and may be formed integrally with outer cover 20. In the illustrated embodiment, inlet 30 and outlet 32 extend away from motor 12 in a direction substantially parallel to output shaft 16. As illustrated in FIG. 2B, inlet 30 passes through holes 48 and 49 located in outer cover 20 and reinforcing plate 34, respectively, to be connected to an outside pipe or hose (not shown), such as a pipe or hose from a liquid reservoir. Outlet 32 may pass through a hole 51 on reinforcing plate 34 to be connected to an outside pipe or hose (not shown), such as an output nozzle.

Inlet chamber 50 is configured to be in fluid communication with pump chamber 28. In some embodiments, pump chamber 28 and inlet chamber 50 are connected via a through hole 56 located on bottom wall 54 of pump chamber 28. Thus, pump chamber 28 is positioned downstream of inlet chamber 50, such that liquid flowing through opening 52 of inlet 30 first enters inlet chamber 50, and then flows to pump chamber 28 via through hole 56 without being driven by the pump mechanism. Pump chamber 28 and inlet chamber 50 are arranged along the axial direction of output shaft 16, at least partially offset from each other in the axial direction, such that inlet chamber 50 is closer to motor 12 than pump chamber 28.

During operation of pump 10, output shaft 16 of motor 12 drives drive gear 22, which in turn drives driven gear 26. Drive gear 22 and driven gear 26 rotate in opposite directions to suck liquid that enters inlet chamber 50 through inlet 30 into pump chamber 28, where it is pressurized and expelled through outlet 32.

In the illustrated embodiment, output shaft 16 passes through inlet chamber 50 in order to reach pump chamber 28 via a through hole in second shell portion 40. The output shaft 16 passes through a through hole 541 defined in the bottom wall 54. That is, the output shaft 16 first extends through the inlet chamber 50 and then enters the pump chamber 28. A side of second shell portion 40 near motor 12 forms a support base 62. A shaft seal 64 is disposed in a through hole in support base 62, sealing the interface between output shaft 16 and the through hole and preventing liquid in inlet chamber 50 from leaking through the through hole to motor 12. A fluid pressure is exerted on the shaft seal 64 from liquid that enters the inlet chamber 50.

During operation, the fluid pressure within inlet chamber 50 is less than that in pump chamber 28. Therefore the pressure exerted on shaft seal 64 is less in comparison with prior art pumps where the shaft seal is subject exposed to the pump chamber. This leads to reduced wear and tear to shaft seal 64, and thus longer operational life for shaft seal 64.

In some embodiments, at least a portion of the bottom surface of inlet chamber 50 forms an inward-projecting convex surface 66. Compared to embodiments where the bottom surface of second chamber 50 is a flat surface, convex surface 66 disperses the pressure exerted on shaft sealing member 64, further reducing wear on shaft seal 64 and extending its operational life.

Figure 4:
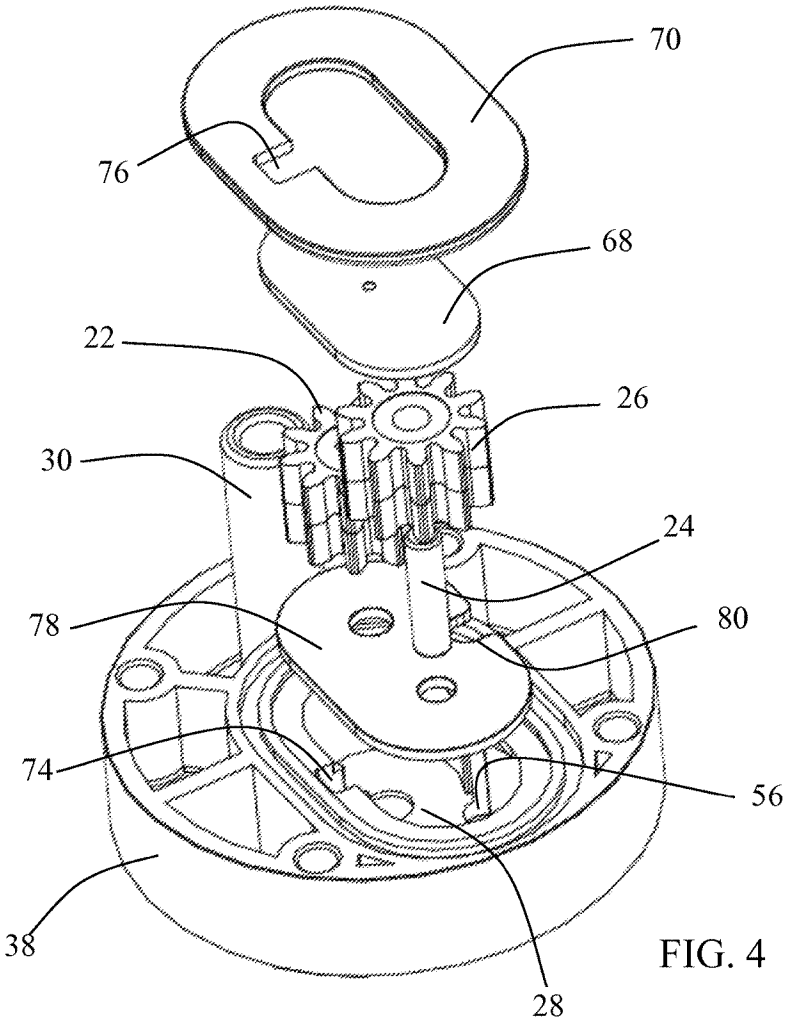
FIG. 4 illustrates a partial view of a liquid pump in accordance with some embodiments.

FIG. 4 illustrates a partial view of pump 10. An inner cover 68 covers an open end of pump chamber 28 remote from motor 12. The outer dimensions of inner cover 68 are configured to substantially coincide with the inner dimensions of pump chamber 28 such that inner cover 68 is able to close the open end of pump chamber 28. In other words, the outer radial surface of inner cover 68 may be substantially flush with the sidewalls of pump chamber 28. An elastic member 70 (e.g., an elastic ring or washer) is disposed between inner cover 68 and outer cover 20, covering the area where inner cover 68 interfaces with the sidewalls of pump chamber 28. Elastic member 70, under the pressure of outer cover 20, exerts pressure on inner cover 68, keeping an axial surface of inner cover 68 in sliding contact with an axial surface of drive gear 22 and driven gear 26, and ensuring efficient operation of pump 10. In some embodiments, elastic member 70 is made of silicone.

In some embodiments, an inner surface of outer cover 20 contains an indentation or recess defining an outlet chamber 72 between inner cover 68, outer cover 20, and elastic member 70. In addition, the sidewalls of pump chamber 28 and elastic member 70 contain grooves, channels, recesses, notches or channels 74 and 76, respectively, through which fluid may flow from pump chamber 28 to within outlet chamber 72. Preferably, notch 76 in elastic member 70 is formed at a periphery thereof to correspond to groove 76 formed on the sidewall of pump chamber 28. In the illustrated embodiments, outlet chamber 72 is provided downstream of pump chamber 28, such that fluid that flows into pump 10 through inlet 30 first enters inlet chamber 50, and then flows into pump chamber 28 before being pumped by drive gear 22 and driven gear 26 into outlet chamber 72. Thus, the fluid pressure within outlet chamber 72 is substantially the same as the fluid pressure within pump chamber 28. In other words, the fluid pressures on both sides of inner cover 68 are substantially balanced, ensuring that the inner axial surface of inner cover 68, under pressure from outer cover 20, remains in sliding contact with the axial surfaces of drive gear and driven gear 22 and 26 with a substantial constant force, preventing a gap from forming between them even as they experience wear and tear, thus ensuring efficient performance of pump 10.

In a preferred embodiment, a spacer or gasket 78 are disposed between a bottom surface of pump chamber 28 and drive and driven gears 22 and 26. In some embodiments, spacer 78 is made of stainless steel, while drive gear 22, driven gear 26, and first shell portion 38 are made of plastic. Spacer 78 prevents gears 22 and 26 from fusing with first shell portion 38 during unloaded operation due to heat generated by gears 22 and 26. Spacer 78 may have a groove 80 provided at a location correspond to through hole 56, allowing liquid to enter pump chamber 28 from inlet chamber 50.

Figure 5:
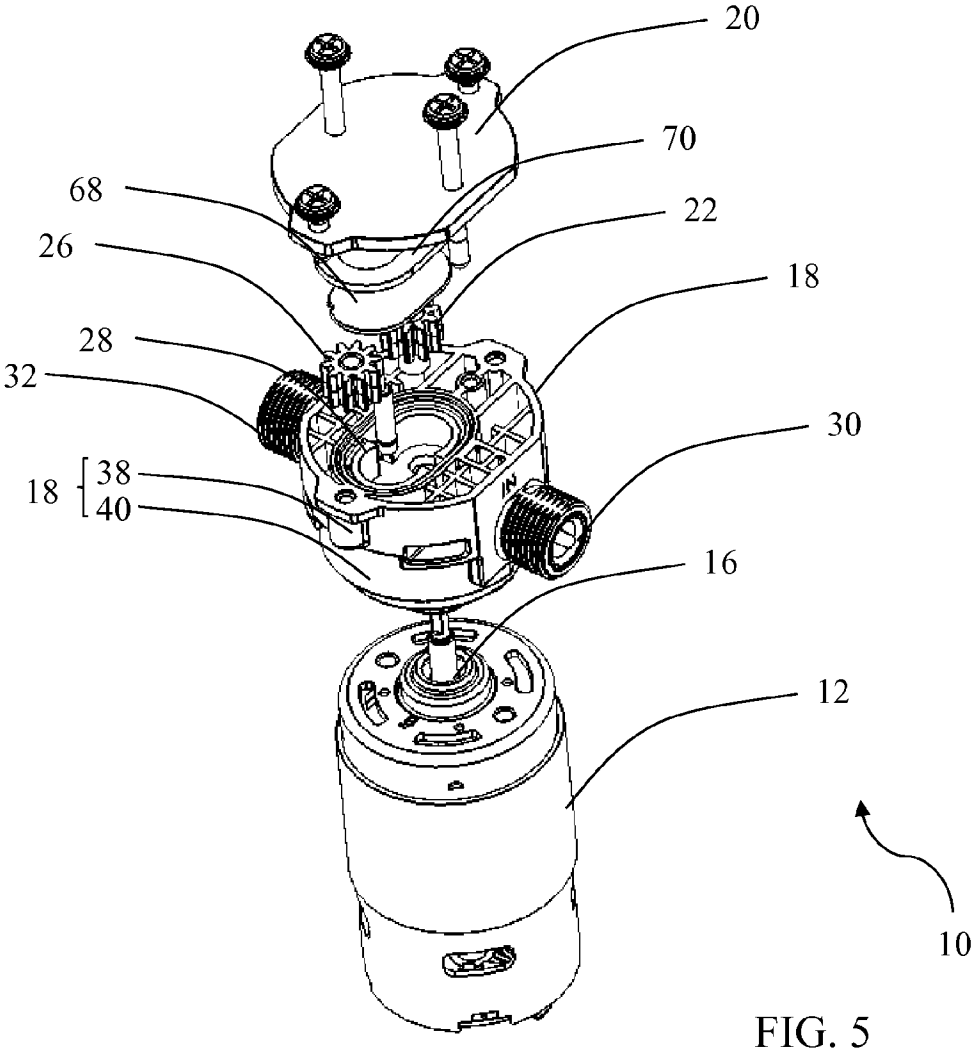
FIG. 5 illustrates another liquid pump in accordance with some embodiments.
Figure 6:
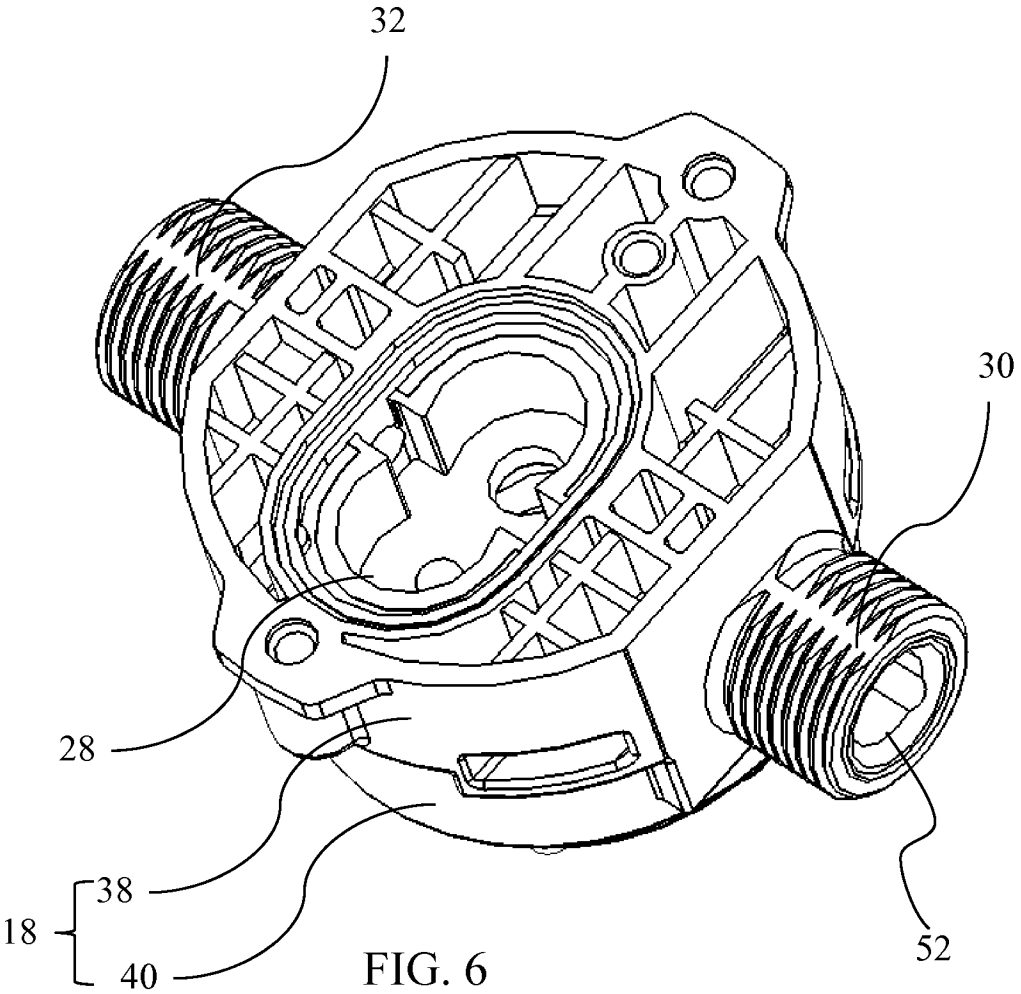
FIG. 6 illustrates first and second shell portions of the liquid pump illustrated in FIG. 5.

In some embodiments, inlet 30 is not limited to extending from first housing portion 38, while outlet 32 is not limited to extending from outer cover 20. The directions of inlet 30 and outlet 32 are also not limited to being substantially parallel to the axial direction of output shaft 16. For example, as illustrated in FIGS. 5 and 6, inlet 30 may extend from second housing portion 40 in a direction substantially perpendicular to the axial direction of output shaft 16, with opening 52 of inlet 30 extending through second housing portion 40 horizontally to be in fluid communication with inlet chamber 50. Similarly, outlet 32 may extend from first housing portion 38 in a direction parallel to inlet 30, such that it is in fluid communication with pump chamber 28. In the embodiment illustrated in FIGS. 5 and 6, pump 10 does not have a separate outlet chamber. In other embodiments, outlet 32 may be configured to be in fluid communication with an outlet chamber, similar to output chamber 72 described herein above with reference to FIG. 2C.

Figure 7A:
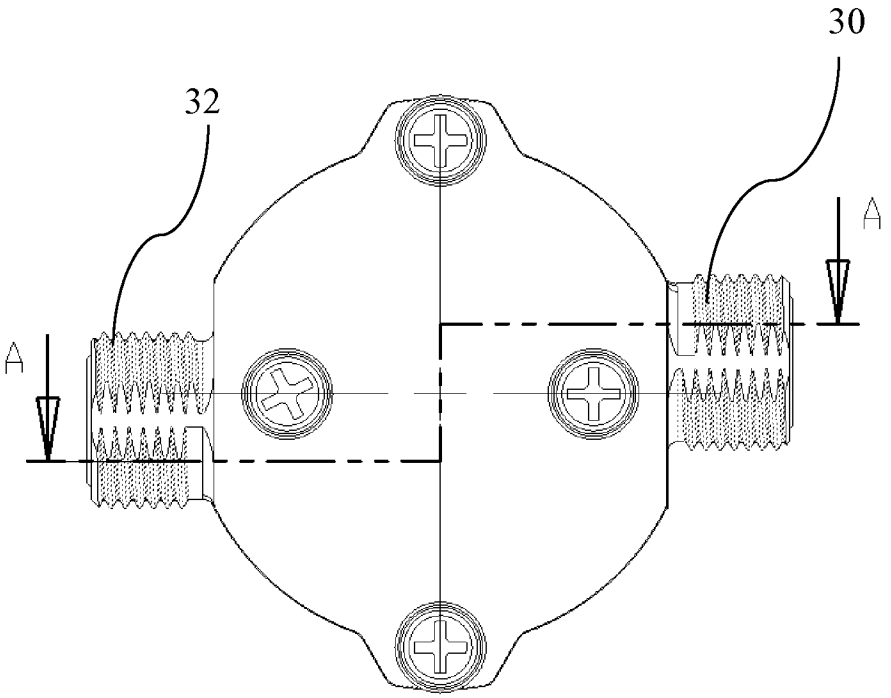
FIGS. 7A and 7B illustrate a top and a cross-sectional of the liquid pump illustrated in FIG. 5.
Figure 7B:
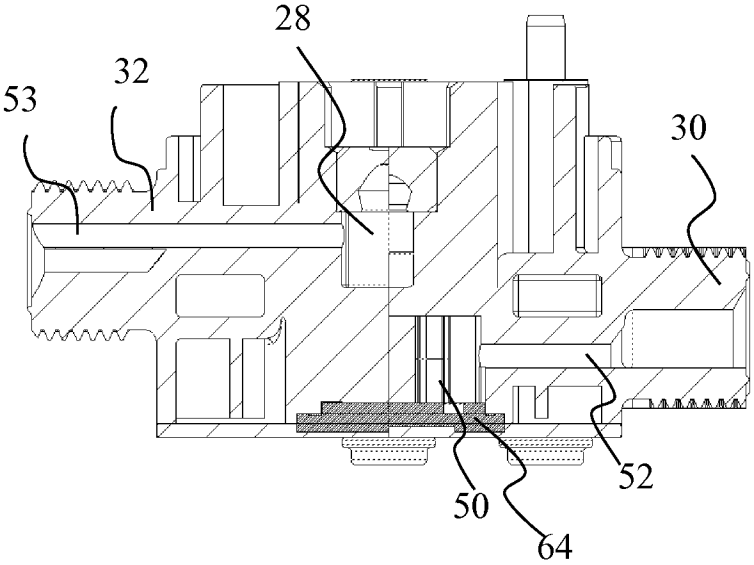

FIG. 7A illustrates a top view of pump 10 in accordance with the embodiment illustrated in FIG. 5; and FIG. 7B illustrates a cross-sectional view of pump 10 along the "A" line shown in FIG. 7A. During operation of pump 10, liquid enters inlet chamber 50 through opening 52 of inlet 30, passes a through hole (not shown and similar to through hole 56 describe herein above with reference to FIGS. 3A, 3B, and 4) into pump chamber 28, where it is pressurized and expelled through an opening 53 of outlet 32. Because shaft seal 64 is adjacent to inlet chamber 50 instead of pump chamber 28, shaft seal 64 experiences less wear and tear due to the lower fluid pressure of inlet chamber 50, increasing the operational life of shaft seal 64.

While the embodiment illustrated in FIGS. 5-7 illustrate inlet 30 and outlet 32 being located on opposite sides of pump 10, in other embodiments, inlet 30 and outlet 32 may be located on the same side of pump 10 and may extend in the same direction. Such configurations would generally decrease the overall volume occupied by pump 10. In some embodiments, inlet 30 and outlet 32 may extend in directions perpendicular to the axial direction of the output shaft 16, and be positioned at an angle with respect to each other (e.g., 90°).

In some embodiments, first shell portion 38 and second shell portion 40 may be integrally formed (e.g., molded by a die), instead of being separate components assembled together. In this configuration, because first and second shell portions 38 and 40 are integrally formed, output shaft 16 will not experience any positional deviation when passing through inlet chamber 50 to reach pump chamber 28 due to a misalignment between first and second shell portions 38 and 40. This may reduce the costs of manufacturing pump 10 by eliminating the need for alignment mechanisms when assembly first and second shell portions 38 and 40.

In some alternate embodiments, an inlet chamber 50 may not be provided. Instead, opening 52 of inlet 30 may connect directly to pump chamber 28. In these embodiments, the pressure of fluid in outlet chamber 72 applies a downward force on inner cover 68, offsetting the upward force from the high pressure of fluid pressure in pump chamber 28, thereby preventing the forming of a gap between inner cover 68 and gears 22 and 26, and increasing the efficiency of pump 10.

In some alternate embodiments, an outlet chamber 72 may not be provided. Instead, pump chamber 28 connects directly to outlet 32. In these embodiments, shaft seal 64 is adjacent to inlet chamber 50 instead of pump chamber 28, and therefore experiences less wear and tear in comparison with prior art due to the lower fluid pressure of inlet chamber 50, thereby increasing the operational life of shaft seal 64.

In the foregoing specification, various aspects have been described with reference to specific embodiments thereof. It will, however, be evident that various modifications and changes may be made thereto without departing from the broader spirit and scope of various embodiments described herein. For example, the above-described systems or modules are described with reference to particular arrangements of components. Nonetheless, the ordering of or spatial relations among many of the described components may be changed without affecting the scope or operation or effectiveness of various embodiments described herein. In addition, although particular features have been shown and described, it will be understood that they are not intended to limit the scope of the claims or the scope of other embodiments, and it will be clear to those skilled in the art that various changes and modifications may be made without departing from the scope of various embodiments described herein. The specification and drawings are, accordingly, to be regarded in an illustrative or explanatory rather than restrictive sense. The described embodiments are thus intended to cover alternatives, modifications, and equivalents.

The invention claimed is:

1. A liquid pump driven by a motor having an output shaft, comprising:

an outer shell including at least a first shell portion having a bottom wall;

an inlet;

a seal;

an inlet chamber in fluid communication with the inlet and having a hole through which the output shaft of the motor extends through;

a pump chamber having a first through hole through which the output shaft of the motor extends through and a second through hole in fluid communication with the inlet chamber, the seal sealing an interface between the output shaft and the hole in the inlet chamber, the pump chamber being separated from the inlet chamber by the bottom wall, and the second through hole being disposed within the bottom wall;

a pump mechanism disposed in the pump chamber and mechanically coupled to the output shaft of the motor; and an outlet in fluid communication with the pump chamber; wherein a fluid pressure in the inlet chamber is less than a fluid pressure in the pump chamber; wherein the pump chamber is positioned downstream of the inlet chamber such that liquid flowing through the inlet first enters the inlet chamber and then flows to the pump chamber;

an inner cover disposed within the pump chamber and in sliding contact with the pump mechanism; an outer cover disposed over the inner cover; and an elastic member disposed between the inner cover and the outer cover, wherein: the inner cover, the outer cover, and the elastic member disposed there between define an outlet chamber in fluid communication with the pump chamber; and the outlet is in fluid communication with the pump chamber through the outlet chamber; and the pump chamber has a groove formed on a sidewall thereof; the elastic member has a notch formed on a periphery thereof; and the outlet chamber is in fluid communication with the pump chamber through the groove on the sidewall of the pump chamber and the notch at the periphery of the elastic member.

2. The liquid pump of claim 1, wherein the inlet chamber is disposed between the motor and the pump chamber along an axial direction of the output shaft of the motor such that the output shaft first extends through the inlet chamber and then enters the pump chamber.

3. The liquid pump of claim 1, wherein the inlet chamber includes a convex surface on a side thereof adjacent the motor.

4. The liquid pump of claim 1, wherein the pump mechanism comprises:

a drive gear coupled the output shaft; and a driven gear that meshes with the drive gear, such that the drive gear and the driven gear are configured to rotate synchronously in opposite directions.

5. The liquid pump of claim 1, wherein the elastic member comprises rubber or silicone.

6. The liquid pump of claim 1, wherein the inlet and the outlet extend in a direction parallel to an axial direction of the output shaft of the motor.

7. A liquid pump, comprising:

an outer shell including at least a first shell portion having a bottom wall;

a motor having an output shaft;

an inlet;

a pump chamber in fluid communication with the inlet;

a pump mechanism disposed in the pump chamber and mechanically coupled to the output shaft of the motor;

an inner cover disposed within the pump chamber and in sliding contact with the pump mechanism; an outer cover disposed over the inner cover;

an elastic member disposed between the inner cover and the outer cover, wherein the inner cover, the outer cover, and the elastic member disposed there between define an outlet chamber in fluid communication with the pump chamber;

an outlet in fluid communication with the outlet chamber; and an inlet chamber in fluid communication with the pump chamber;

a seal sealing an interface between the output shaft and a hole in the inlet chamber, wherein the inlet is in fluid communication with the pump chamber through the inlet chamber such that liquid flowing through the inlet first enters the inlet chamber and then flows to the pump chamber, and the pump chamber is separated from the inlet chamber by the bottom wall; and the pump chamber has a groove formed on a sidewall thereof;

the elastic member has a notch formed on a periphery thereof; and the outlet chamber is in fluid communication with the pump chamber through the groove on the sidewall of the pump chamber and the notch at the periphery of the elastic member.

8. The liquid pump of claim 7, wherein the pump mechanism comprises:

a drive gear coupled the output shaft; and a driven gear that meshes with the drive gear, such that the drive gear and the driven gear are configured to rotate synchronously in opposite directions.

9. The liquid pump of claim 7, wherein the inlet chamber is disposed between the motor and the pump chamber along an axial direction of the output shaft of the motor such that the output shaft first extends through the inlet chamber and then enters the pump chamber.

10. The liquid pump of claim 9, wherein the inlet chamber includes a convex surface on a side thereof adjacent the motor.

* * * * *